United States Patent [19]

Julien, Jr.

[11] Patent Number: 4,780,996

[45] Date of Patent: Nov. 1, 1988

[54] FOLDING HOUSE

[75] Inventor: Romeo Julien, Jr., Quebec, Canada

[73] Assignee: Les Maisons Quebeco Inc., Val d'Or, Canada

[21] Appl. No.: 640,863

[22] Filed: Aug. 15, 1984

[30] Foreign Application Priority Data

Sep. 2, 1983 [CA] Canada ..... 435977

[51] Int. Cl.[4] ..... E04B 1/344; E04B 7/16

[52] U.S. Cl. ..... 52/68; 52/69; 52/79.5

[58] Field of Search ..... 52/68, 69, 70, 79.5; 296/26, 27, 173

[56] References Cited

U.S. PATENT DOCUMENTS

| | | | |
|---|---|---|---|
| 337,180 | 3/1886 | McCoy | 52/69 |
| 2,780,844 | 2/1957 | Bolt | 52/69 |
| 2,890,498 | 6/1959 | Bigelow | 52/69 |
| 3,844,063 | 10/1974 | Jackson | 52/69 X |
| 4,155,204 | 5/1979 | Prozinski | 52/69 |

FOREIGN PATENT DOCUMENTS

| | | | |
|---|---|---|---|
| 1155552 | 7/1956 | France | 52/68 |
| 1174156 | 4/1957 | France | 52/68 |

*Primary Examiner*—John M. Jillions

*Attorney, Agent, or Firm*—Cushman, Darby & Cushman

[57] ABSTRACT

The invention relates to improved means used to fold and/or unfold a portable building of the type in which members are hingedly connected to a rigid central section to reduce its external volume and facilitate transportation of the building. The rigid central section comprises a floor, walls and roof. Additional roof members are pivotally connected to the roof along opposed parallel edges so as to be movable between an extended position in which they form a continuation of the central roof, and a further position in which they are disposed parallel with the vertical walls of the central section. Additional floor members are connected to opposed parallel edges of the central section floor which are parallel with the additional roof members. The additional floor members are moveable to form an extension of the central section floor or to be parallel with the central section walls. The folding/unfolding means comprise a triangular structure which is removably transversely secured to each additional roof member, a flexible cable extending between the respective triangular structures and means for increasing or decreasing the length of cable to effect simultaneous, opposite pivotal movement of the additional roof members.

3 Claims, 4 Drawing Sheets

FOLDING HOUSE

Field of the Invention

This invention relates to improved means for folding and/or unfolding a portable building of the kind comprising a rigid central structure and roof, floor and end wall sections hingedly connected to the rigid central structure.

Description of the Prior Art

Similar structures have been disclosed for example in U.S. Pat. Nos. 2,780,844 and 4,155,204, French Pat. No. 1,155,522 and Canadian Pat. Nos. 430,577, 438,108, 438,110 and 835,103.

Some of the proposed structures relate more to mobile homes which can be moved frequently while others relate to prefabricated buildings which are not likely to be moved very frequently but which can be made to fold.

The additional roof members of such structures can be unfolded using known lifting equipment and temporarily held in place by such lifting equipment or by the use of posts which can be later removed. However, such equipment may not be readily available in remote locations or may be costly to rent or to transport to the location and back. Furthermore, the use of such equipment is very often time consuming thus increasing the cost of folding and/or unfolding of the structure.

Prozinski, in his U.S. Pat. No. 4,155,204 and McCoy in his U.S. Pat. No. 337,180 suggest mechanisms which are permanently secured to the central portion of structure for effecting the movement of moveable roof members. However, such mechanisms cannot be used for folding and/or unfolding prefabricated buildings because of aesthetical reasons and because of the increased cost of each such building.

DISCLOSURE OF THE INVENTION

An object of the invention is to provide a building of the type described which is aesthetic and yet can be readily and economically erected.

A further object is to provide a folding building which can be erected with a minimum of additional equipment.

BRIEF DESCRIPTION OF THE DRAWINGS

In order that the invention can be understood and readily carried into effect and so that the aforementioned objects will be apparent a portable building in accordance with the invention will now be described, by way of example only, with reference to the accompanying drawings, in which.

BRIEF DESCRIPTION OF A PREFERRED EMBODIMENT

Figure 1:
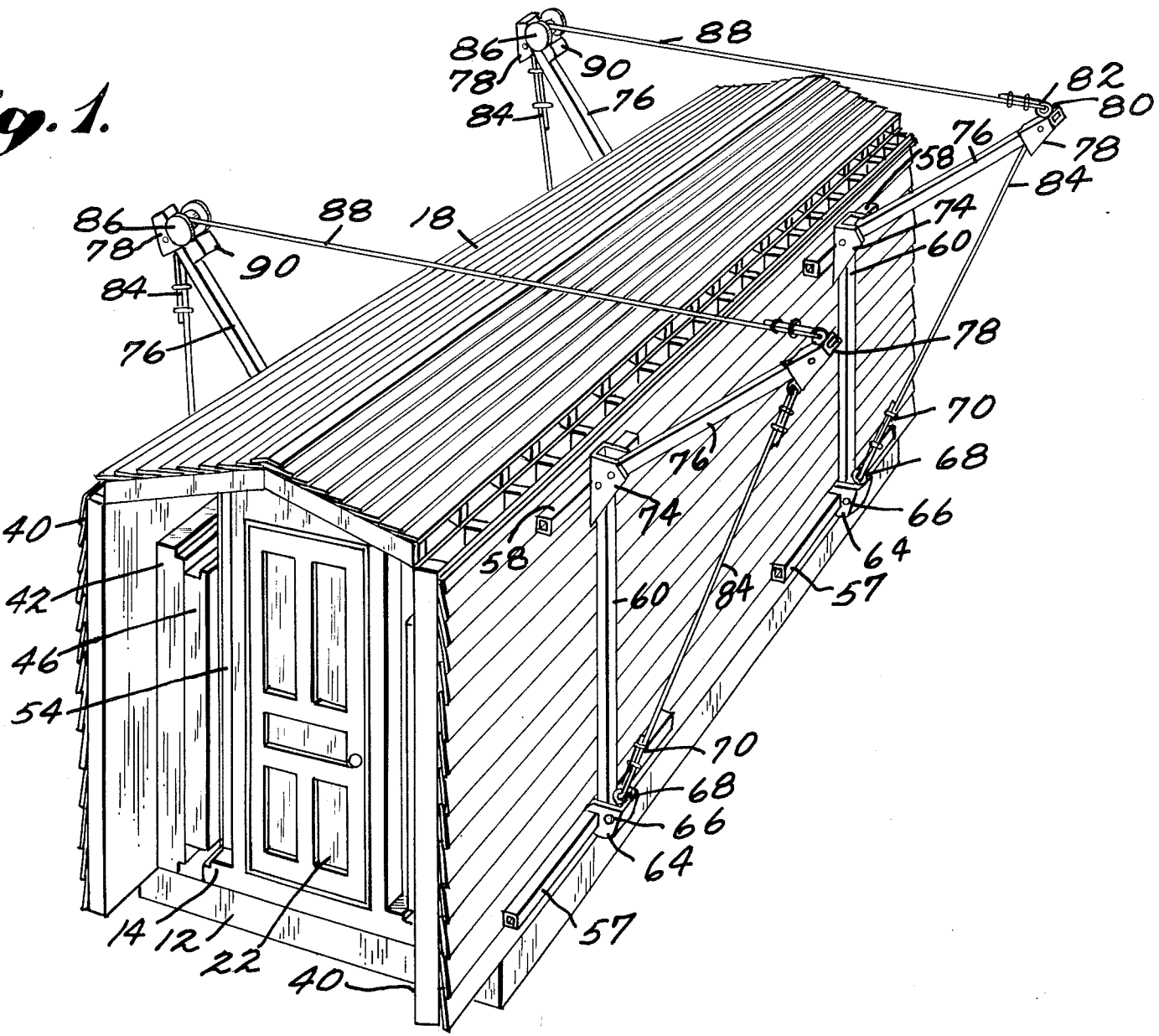
FIG. 1 is a perspective view of a portable building in the folded condition on which folding/unfolding means in accordance with the invention have been secured.

Referring to the drawings, numeral 10 indicates a rigid central structure comprising sitting on a rectangular base 12 having a floor 14 mounted thereon.

The floor 14 is also rectangular in shape and rigidly supports a plurality of vertical members 16 which at their upper ends support a roof member 18. As can be seen from the drawings the outer longitudinal edges of the roof member 18 project beyond the outer edges of the members 16, whilst the longitudinal edges of the floor 14 are parallel with but disposed inwardly of the longitudinal edges of the base 12. A door opening 20 is provided in each end of the central structure 10 and a door 22 is mounted in each doorway, to provide access to the central structure.

Figure 4:
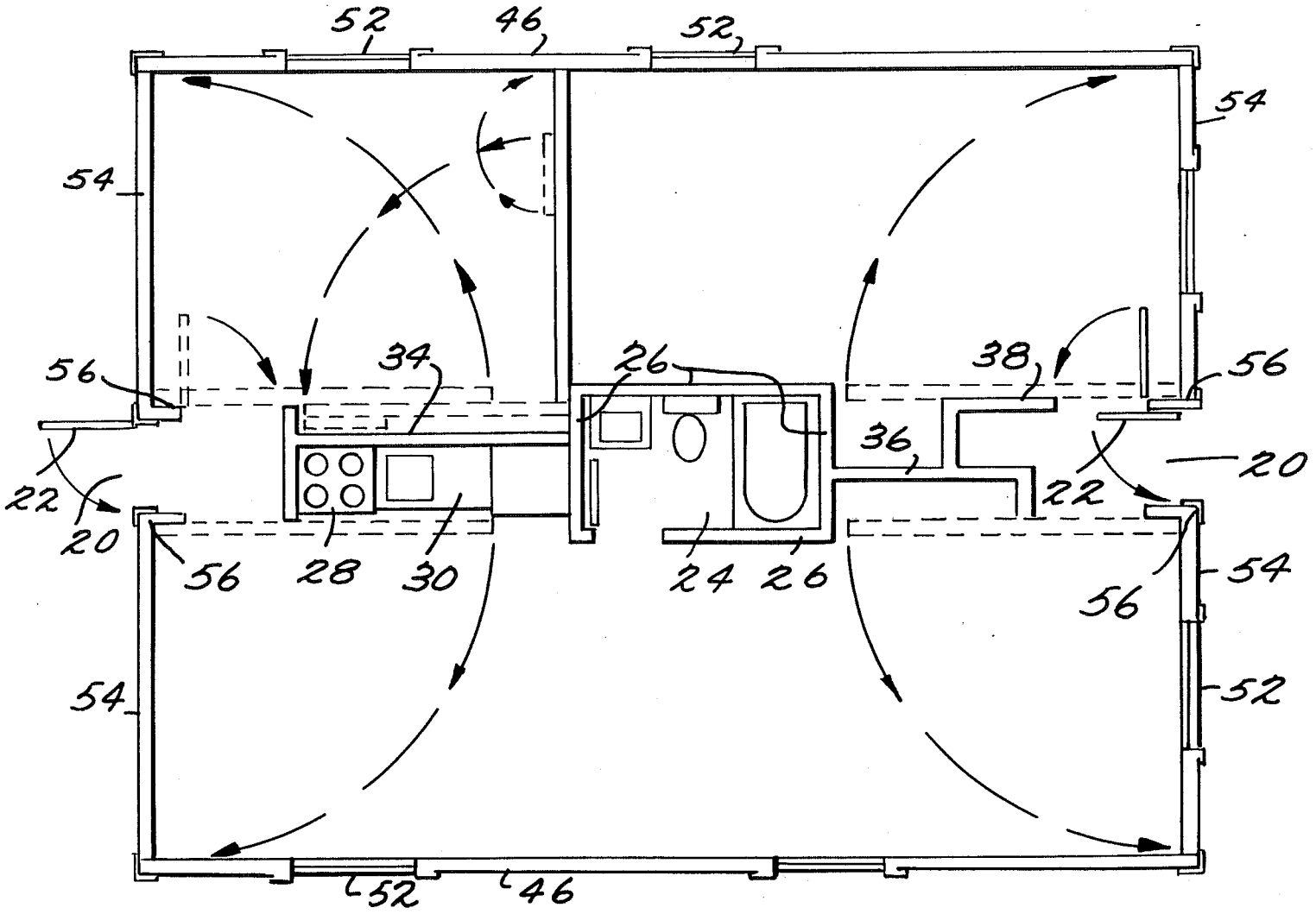
FIG. 4 is a plan view of the building shown in FIG. 1, but with the roof removed.

As shown in FIG. 4 of the drawings a portion of the central structure 10 supports a complete bathroom 24, which is enclosed within partitions 26, in addition to kitchen equipment including a stove or cooker 28, a sink unit 30 and a refrigerator 32.

The central section also supports all the plumbing, and an important portion of the electrical wiring for the building, which plumbing and wiring features are not shown, since they are well known to those skilled in the art.

The kitchen equipment is contained within an area defined by a partition 34 extending lengthwise of the base 12 away from the bathroom partition 26 and an additional partition 36 which extends transversely of the partition 34 at its end remote from the bathroom 24.

Further partitioning 38 is mounted on the base 12 and projects from partitions 26 in the opposite direction to the partition 34, and has openings or doorways therein.

Figure 2:
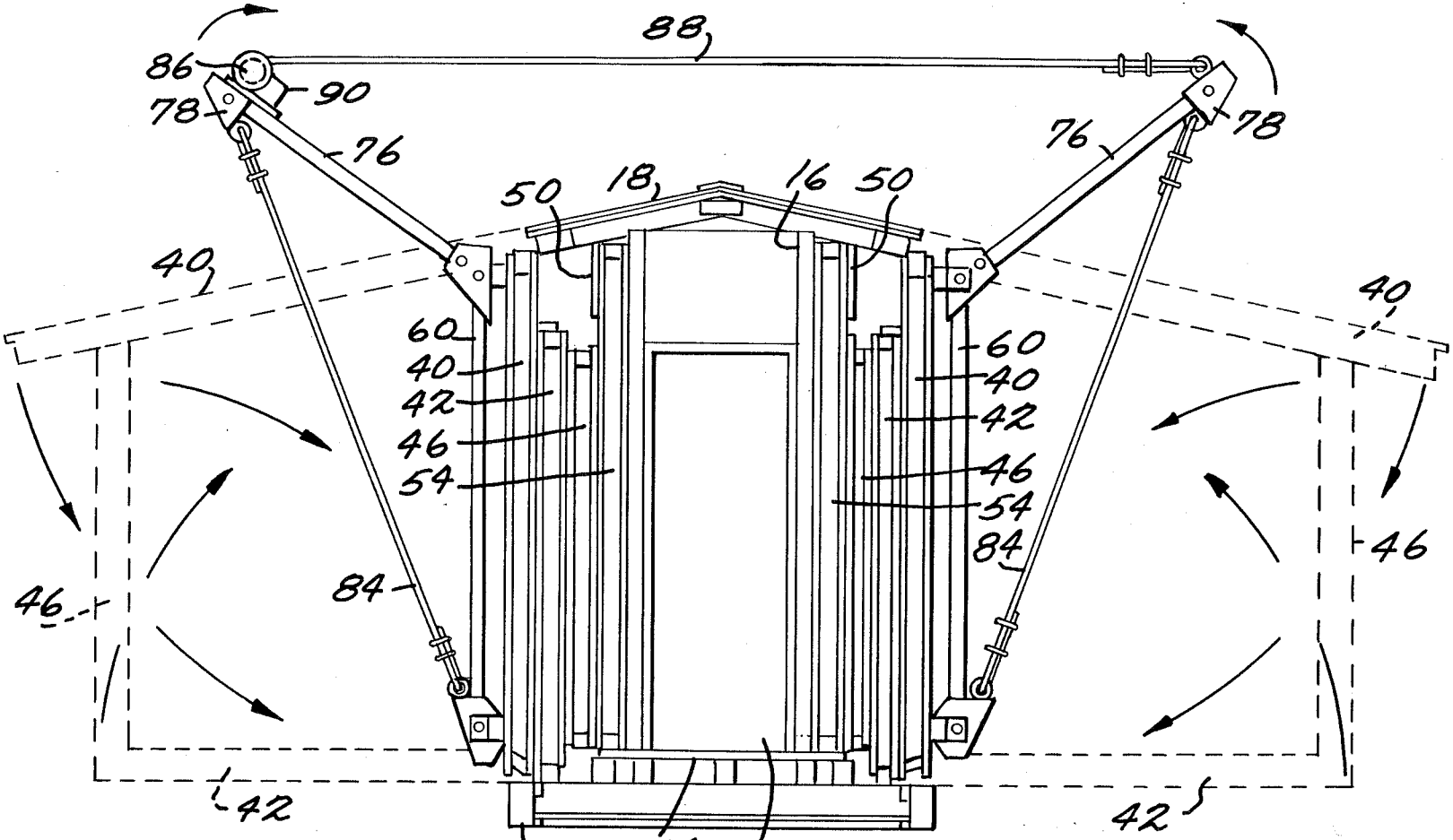
FIG. 2 is a cross-sectional view of the building shown in FIG. 1 of the drawings, but with both side portions in the folded condition.

An additional roof member 40, of the same thickness and length as the roof member 18 is pivotally connected to each longitudinal lower edge of the roof member. Each roof member 40 is pivotable between a position where it is parallel with and forms a continuation of the adjacent portion of the roof member 18 and a further position in which it lies parallel with the vertical face of the central section 10, as shown in FIG. 2 of the drawings.

An additional floor member 42 of the same length as the base 12, is pivotally connected to each longitudinal edge of the base 12, and is equal in thickness to the height of the floor 14 above the base 12. The additional floor members 42 are connected to the base 12 by means of hinges 44 which permit the associated floor member 42 to be pivoted between a position in which it is disposed in the same plane as the floor 14 and a further position in which it is parallel with the vertical face of the central section 10.

The location of the hinges 44 on the base 12 is selected such that when the member 42 is disposed parallel to the vertical face of the central structure 10, it will be disposed inwardly of the location of the roof member 40 when the roof member is positioned so that it lies parallel with the vertical face of the central structure 10.

A wall member 46 is pivotally connected to the end of each floor member 42 remote from its hinges 44, by means of hinges 48, the hinges permitting the wall member to pivot between a position in which it is parallel with the floor member 42 and a further position in which it is disposed at right angles thereto, to form a wall of the building.

Figure 3:
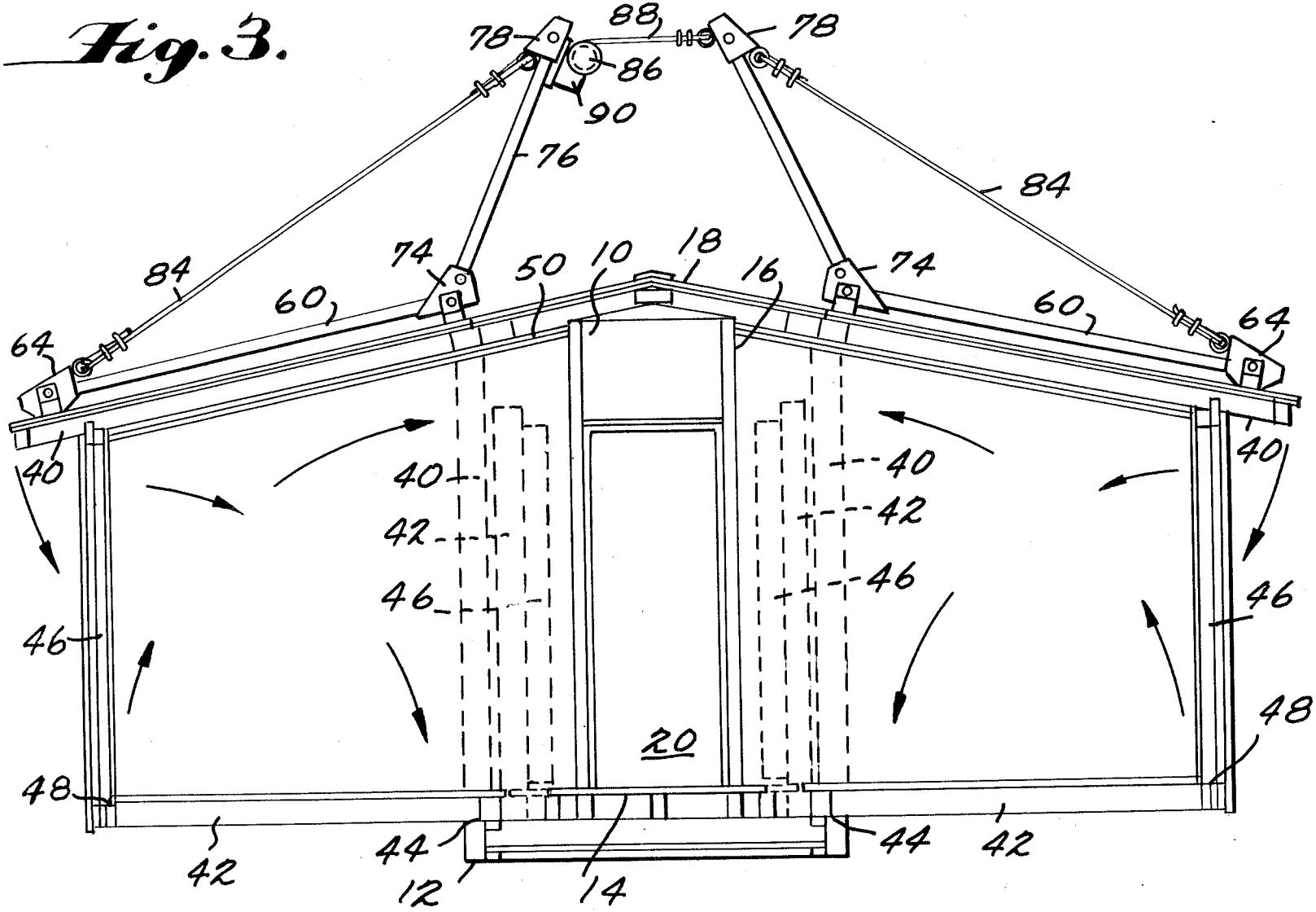
FIG. 3 is a cross-sectional view of the building shown in FIG. 1, but with both side portions in an extended position.

Sealing members 50 are pivotally mounted on the inner face of the roofing member 18, and are positioned such that they will extend over the abutting surfaces of the roof members 18 and 40, as shown in FIG. 3 of the drawings.

The wall member 46 described above provide the front and rear walls of a building in accordance with the invention, each being provided with windows 52, whilst the end walls are provided by structural members 54, pivotally connected to the central structure.

As can be seen from FIG. 4 of the drawings each member 54 is pivotally connected to the central structure by means of a vertically disposed hinge or hinges 56 mounted on the vertical members 16 at each end of the base 12, and between which the doorways 20 are defined. Thus the members 54 can be pivoted between a position in which they are disposed to provide end walls of the building and a position in which they are disposed within the boundaries of the base 12, parallel with the longitudinal edges thereof.

When the above described building is to be transported the additional roof members 40, floor members 42, wall members 46 and 54 are disposed in the positions shown FIGS. 1 and 2 of the drawings.

Upon arrival at the location where the building is to be erected, it is removed from the transport vehicle, and its base 12 is mounted on suitable supports not shown. The supports may comprise previously constructed concrete plinths, jack type supports or any other known support devices or structures.

With the central section correctly located on its supports, the additional roofing members 40 are raised to the position shown in FIG. 3 of the drawings and the floor members 42 are lowered to the horizontal position. The wall members 46 are subsequently moved to a vertical position and secured to the roof members 40 to retain the roof members 40 in the raised position.

Finally, the end walls 54 are pivoted about their hinges to the full line position shown in FIG. 4 of the drawings and secured to the associated front or rear wall.

To facilitate movement of the additional roof members 40 between the positions shown in FIGS. 2 and 3 of the drawings, means are provided for effecting simultaneous pivotal movements of the members.

Each additional roof member 40 has two pairs of structures each comprising elongated tubular members 57, 58, 60 and 76, brackets 64, 74 and 78 and cable 84.

Each of these structures is secured transversely on the roof member 40 by bolts which extend through member 57 near the side of roof member 40, which is distal from central section 10. Member 58 simply leans against roof member 40 and is parallel with member 57 but near the other side of the roof member 40.

A tubular member 60 extends between each pair of members 57 and 58, one end having plates mounted thereon which are adapted to engage over the frame 57 and are disposed between brackets 64 attached to the frame 57. A bolt 66 extends through the brackets 64, the plates and the member 60 to detachably secure the said one end to the member 57. A plate 68 is secured between the plates as is provided with a hole 70.

The other end of the member 60 also has a pair of spaced apart plates, not shown, attached thereto which are disposed between brackets 74 which are attached to the member 58 and detachably secured therebetween by a nut and bolt.

An arm 76 is supported between the brackets 74 on each member 60 and projects upwardly and inwardly of the building towards the arm 76 supported on an opposite member 60. The end of each arm 76 remote from the member 60 has a pair of spaced apart plates 78 mounted thereon which support between them a plate 80 incorporating a hole 82.

A cable 84 is connected between the arm 76 of each structure remote from the member 60 and the plate 68 mounted on the same member 60.

In addition, a winch 86 is mounted on one arm of each opposed pairs of arms 76, the free end of the cable 88 being connected to the other of the opposed pair or arms 76 by connection to the plate 82 through the hole 80 or by any or appropriate means.

Each winch 86 is adapted, by means not shown, but which are well known to those skilled in the art, to be rotated by means of an electric motor 90, the said means being such as to effect simultaneous rotation of each winch 86 in a common direction.

It can be seen that the folding/unfolding means can be easily disassembled to facilitate storage and transportation as required.

Thus when a building as described above is to be erected from the position shown in FIG. 2 of the drawings to the position shown in FIG. 3, the winches 86 are simultaneously rotated in a direction to wind the cables 88 onto their respective winch.

The roof members 40 are therefore simultaneously moved to the position shown in FIG. 3 whereupon the electric motor 88 is switched off, and the roof members 40 will be retained in that position until the additional floor members 42 and wall members 46 are positioned so as to support the roof members 40.

When the roof members are so supported the structures comprising members 57, 58, 60 and 76, brackets 64, 74 and 78 and cable 84, and associated winches 86 and cable 88 and cable drums 86 and cable 88 can be detached, and stored until it is necessary to return the building to the condition shown in FIG. 3 of the drawings or used to fold or unfold another similar building.

It will be seen therefore that the above described means for folding and unfolding the additional roof members 40 can be supported wholly on the additional roof members and that the only external source required is a supply of electricity. However it will be appreciated that a source of power other than electricity may be employed to effect rotation of the drum without departing from the basic concept of the folding and unfolding means.

The embodiments of the invention in which an exclusive property or privilege is claimed are defined as follows:

1. An apparatus to fold and/or unfold an portable building of the type in which additional roof, end wall and floor members being connected to a rigid central section by hinge means comprising:

(a) a pair of triangular structures each of which has an arm which projects upwardly and outwardly relative to said rigid central section in the unfolded position of said additional roof member;

(b) means for removably securing each of said triangular structures to its respective additional roof member along the transverse direction of said additional roof member, (c) a winch mounted on one of said arm at the end of the arm distal from the portable building, and (d) a cable extending between said winch and said other arm, whereby when said winch is actuated to wind up said cable both said additional roof members unfold.

2. An apparatus to fold and/or unfold a portable building as recited in claim 1 wherein each said triangular structure, includes means for collapsibly folding each of said triangular structures.

3. An apparatus to fold and/or unfold a portable building as recited in claim 1 or 2 in which each triangular structure comprises:

(a) a first tubular member bolted in the longitudinal direction on said additional roof member, near the side of said additional roof member which is distal from the central section, (b) a second tubular member, parallel with the first tubular member, which leans against the additional roof member, near the side which is proximate to the central section, (c) a third tubular member extending between and secured to said first and second tubular members; and (d) a fourth tubular member, secured near the end of said third tubular member which is near said second tubular member.

* * * * *